US005842325A

United States Patent [19]

Godly et al.

[11] Patent Number: 5,842,325

[45] Date of Patent: Dec. 1, 1998

[54] METHOD FOR LABELING PACKAGES

[75] Inventors: Margaret Mary R. Godly, Farmington; Joan L. Pierce, Honeoye Falls, both of N.Y.

[73] Assignee: Bausch & Lomb Incorporated, Rochester, N.Y.

[21] Appl. No.: 989,017

[22] Filed: Dec. 11, 1997

[51] Int. Cl.[6] ..... B65B 61/26; B65B 55/02

[52] U.S. Cl. ..... 53/411; 53/425; 53/467

[58] Field of Search ..... 493/53, 54, 55, 493/320; 206/5.1, 459.5; 53/167, 131.2, 131.3, 131.4, 131.5, 411, 425, 426, 467, 52

[56] References Cited

U.S. PATENT DOCUMENTS

| | | | |
|---|---|---|---|
| 5,025,610 | 6/1991 | Grayshar | 53/411 |
| 5,099,633 | 3/1992 | Gombault et al. | 53/411 |
| 5,189,863 | 3/1993 | Pozzi | 53/411 |
| 5,396,984 | 3/1995 | Wanders | 206/5.1 |
| 5,445,367 | 8/1995 | Long | 53/411 X |
| 5,488,815 | 2/1996 | Abrams et al. | 53/467 X |
| 5,565,059 | 10/1996 | Edwards et al. | 156/517 |
| 5,577,367 | 11/1996 | Abrams et al. | 53/411 X |
| 5,578,331 | 11/1996 | Martin et al. | 425/445 |
| 5,607,642 | 3/1997 | Lepper et al. | 206/5.1 X |
| 5,620,087 | 4/1997 | Martin et al. | 206/820 X |
| 5,704,190 | 1/1998 | Kaneko et al. | 53/131.2 X |
| 5,715,653 | 2/1998 | Weinmann et al. | 53/411 |

FOREIGN PATENT DOCUMENTS

| | | | |
|---|---|---|---|
| 3303109 | 8/1984 | Germany | 53/411 |

*Primary Examiner*—Daniel Moon
*Attorney, Agent, or Firm*—John E. Thomas

[57] ABSTRACT

A method for labeling packages containing contact lenses involves applying to a package that contains a contact lens a machine-readable code identifying characteristics of the contact lens in the package, and later applying to the package printed language information generated from the machine readable code. The printed language information can be applied to the package at a site and/or time remote from the packaging and sterilization operations while ensuring product integrity.

7 Claims, 2 Drawing Sheets

METHOD FOR LABELING PACKAGES

BACKGROUND OF THE INVENTION

This invention relates to a method for labeling packages containing contact lenses. The method involves applying to a package that contains a contact lens a machine-readable code identifying characteristics of the contact lens in the package, and applying to the package after sterilization, printed language information generated from the machine readable code. The printed language information can be applied to the package at a site and/or time remote from the packaging and sterilization operations.

A conventional manner of packaging contact lenses is in so-called "blister packages". Such packages include a recess designed to hold an individual lens, with the lens usually being immersed in a saline solution in the case of soft hydrogel lenses. The packages are then enclosed and sealed with a lidstock. The packages include printed language information on their exterior, to indicate details on the package contents, for example, the type of contact lens, and usually other information, for example, the manufacturer or brand name.

A conventional manner of marking the packages involves, prior to sterilization, applying to the package a label or some type of printing that includes desired printed language information identifying specifications and/or manufacturing data of the contact lens contained in the package. A drawback of this approach is that this "final" label or printing must be able to withstand sterilization conditions. It is also possible to add the desired printed language information to the package immediately after sterilization, a drawback of this latter approach being that the information regarding specifications and/or manufacturing data of the lenses must be tracked through the sterilization operation to maintain product integrity, which can be an issue when the sterilization operation is a batch process (i.e., following packaging, lenses are not immediately sterilized). A drawback of both approaches is that once the "final" label or printing is applied to the package, adding additional printed language information or changing the printed language information is difficult.

SUMMARY OF THE INVENTION

The present invention provides a method comprising: packaging and sterilizing a contact lens, wherein packaging comprises placing a contact lens in a recess of a package and sealing the recess with lidstock, and wherein sterilization comprises sterilizing the package contents; applying to the package a machine-readable code including information identifying specifications of the contact lens contained in the package; and subsequently, applying to the package printed language information generated from the machine-readable code and identifying specifications of the contact lens contained in the package. Preferably, the method comprises the following sequential steps: packaging the contact lens; applying to the package the machine-readable code; sterilizing the package contents; and applying to the package the printed language information generated from the machine-readable code.

Accordingly, it is possible to add desired printed language information subsequent to the packaging operation while ensuring product integrity (i.e., ensuring that an individual package includes obtainable information on the specifications of the contact lens contained therein). Also, it is possible to apply printed language information to the package at a site remote from the packaging and sterilization operations. As an example, in the case where one manufacturing site is supplying product to multiple locations with different labeling requirements, the method allows the desired printed language information to be added to the package locally rather than requiring the base manufacturing site to supply and inventory multiple packages with the different labeling requirements.

BRIEF DESCRIPTION OF THE DRAWING FIGURES

DETAILED DESCRIPTION OF PREFERRED EMBODIMENTS

Figure 1:
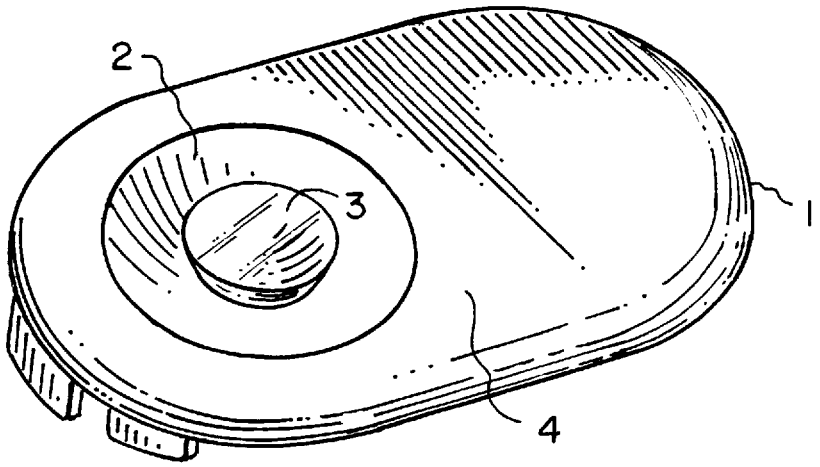
FIG. 1 is a top perspective view of a contact lens blister package.
Figure 2:
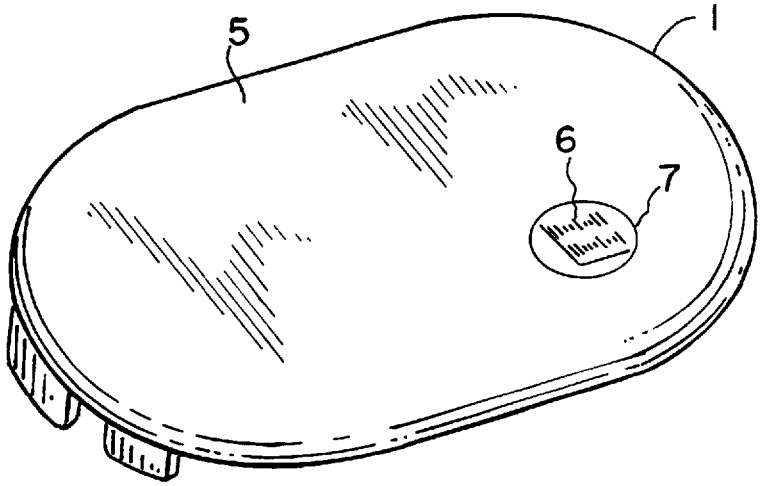
FIG. 2 is a top perspective view of the blister package of FIG. 1 with lidstock in place.
Figure 3:
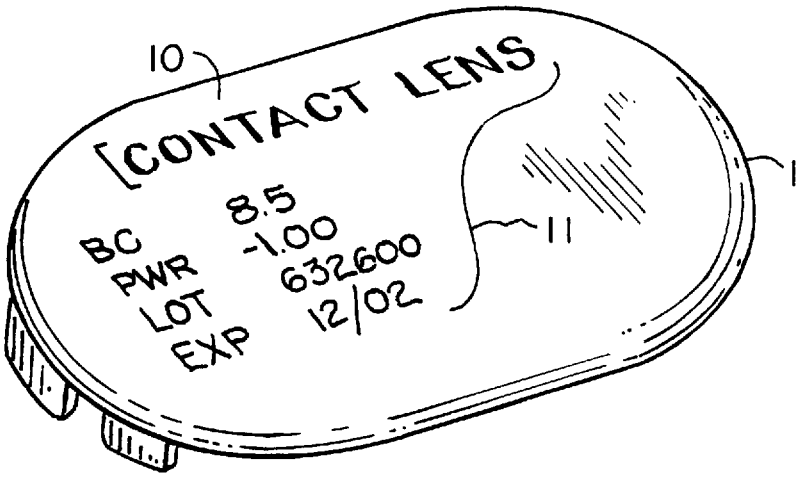
FIG. 3 is a top perspective view of the blister package of FIGS. 1 and 2 with a label contained printed language information according to a first embodiment.

FIGS. 1 to 3 illustrate a blister package for contact lenses, it being understood, however, that the invention is applicable to other blister packages. As seen in FIG. 1, contact lens 3 is placed in recess 2 of blister package 1, recess 2 designed to hold an individual contact lens. Conventionally, recess 2 will also be partially filled with saline solution in the case where the contact lens is a soft hydrogel contact lens. Recess 2 terminates at surface 4.

As seen in FIG. 2, lidstock 5 is sealed to surface 4 so as to sealingly encase recess 2 and enclose package 1, in other words, the function of the lidstock is to sealingly enclose lens 3 (and saline solution, if present) in recess 2. The lidstock is conventionally a lidstock containing an aluminum layer, such lidstock being sufficiently durable to protect the package contents during shipping and storage and also able to withstand sterilization conditions.

As seen in FIG. 2, machine-readable code 6 is applied to the package on lidstock 5. As used herein, the term "printed language information" denotes information that includes printed words and/or numerals, i.e., words and/or numerals that are readily discernible by a person. As used herein, the term "machine-readable code" denotes symbols forming an informational code that is machine-readable and that is not directly readable by a person (i.e., is not readily discernible by a person without the aid of a machine or without otherwise decoding the symbols). Thus, a "machine-readable code" requires machine assistance to read the code and translate the code into "printed language information".

An example of machine-readable code is high-density two-dimensional bar code, such as code commonly referred to as "data matrix bar code". For the described embodiment, code 6 is first imprinted on tag 7 and then the tag is applied to the package. (Alternately, code 6 could be imprinted directly on the lidstock.)

Code 6 includes relevant information on the specifications of the specific lens 3 included in the package, particularly lens power and lens dimensions (for example, diameter and/or base curve). Code 6 may also include information relating to the manufacturing process used for the specific contact lens, such as manufacturing lot number and manufacturing date or expiration date derived from the manufacturing date. Code 6 can be printed on tag 7 (or directly to lidstock 5 if desired, as mentioned above) by an ink jet or thermal transfer printer, one example being a thermal transfer printer suitable for printing data matrix code, like those manufactured by Sato America (Sunnyvale, Calif., USA). For the described embodiment, code 6 is readable with a reader suitable for reading data matrix code, one example being a reader available from Acuity Imaging Inc. (Nashau, N.H., USA).

After applying tag 7 containing code 6, the package and its contents are sterilized, for example, in an autoclave. It is within the scope of the invention to apply code 6 to the lidstock prior to sterilization, but in this case, it is necessary to ensure that the packages are tracked and identified through the sterilization operation to ensure product integrity. For this reason, it is preferred that code 6 is applied to the package prior to sterilization, and further that code 6 is applied to the package immediately after packaging the lens in the blister package, thereby providing the benefit of ensuring product integrity at all points following the packaging operation via code 6 applied to each individual package.

Additionally, it will be appreciated that it is unnecessary to immediately label the package with printed language information. Rather, since code 6 contains the relevant information regarding the lens specifications and manufacture, the sterile, packaged lens can be inventoried for later application of printed language information to the package, or shipped to a site remote from the manufacturing site without the printed language information. As an example, packaged lenses manufactured at a single manufacturing site can be shipped to multiple countries having different language requirements; at these downstream sites, code 6 is read, and a final labeling, including printed language information generated from reading code 6, can be added to the contact lens package.

Figure 4:
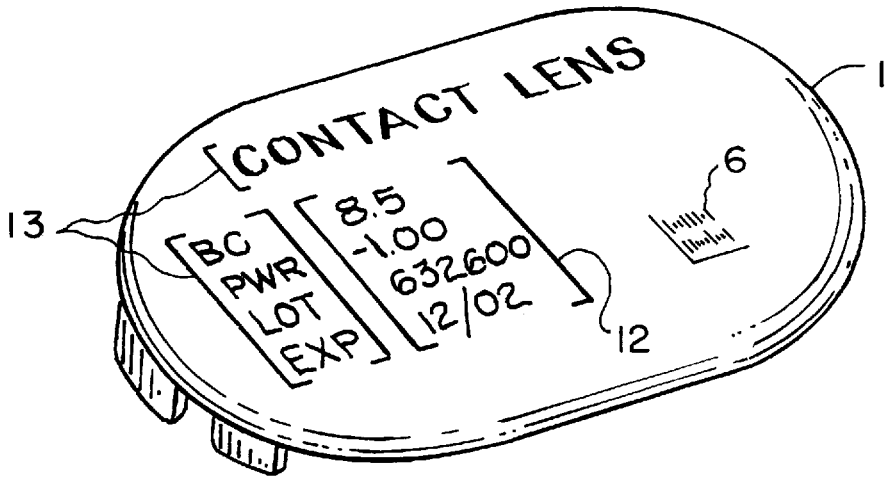
FIG. 4 is a top perspective view of the blister package of FIGS. 1 and 2 with a label contained printed language information according to a second embodiment.

According to a preferred embodiment, an adhesive-backed label 10, having printed thereon the printed language information 11 derived from code 6, is adhered to the lidstock of one or more contact lens packages. Alternately, this final labeling could be printed language information derived from code 6 and applied directly to the lidstock, such as by an ink jet or thermal transfer printer. As yet another alternative, as shown in FIG. 4, it is within the scope of the invention for the package to add printed language information 12 derived from code 6 to lidstock that already includes initially partial printed language information 13 (i.e., partial printed language information is initially present in addition to the machine-readable code 6); one example where this may be desirable is the case where a tradename or other text is common to all packages regardless of ultimate destination. FIG. 4 also illustrates that it is not required to conceal code 6 with the added printed language information.

The method of this invention can greatly reduce the types of packaged lenses to be inventoried. Only lenses without printed language information need to be inventoried and printing of the language information can be performed reliably later, and, as mentioned, at a remote site if desired. Nonetheless, the package would still include machine-readable code 6, and code 6 would be used to generate additional printed language information obtained from code 6 at a time and/or site remote from the packaging and sterilization operations.

Following the provision of the final labeling including all printed language information, individual blister packages can be placed in a secondary carton, conventionally having the form of a paperboard box designed to hold a predetermined number of contact lens packages. Frequently, an insert is added to the secondary carton along with the packaged lenses, the insert providing further printed language information, for example, instructions for a user of the lens. If desired, the insert can be specific to the lenses in a specific secondary carton, whereby information read from code 6 is also used to generate part of the printed language information in the insert for a specific carton.

Many other modifications and variations of the present invention will be evident to the skilled practitioner. For example, as mentioned above, the invention is applicable to other blister packages than those shown in the figures, and is adaptable to the packaging operations therefor. For example, blister packages may be interconnected with a single sheet of lidstock, or alternately, the adhesive-backed label may be adhered to multiple blister packages having individual sections of lidstock. It is therefore understood that, within the scope of the claims, the present invention is not limited to the described preferred embodiments and can be practiced other than as herein specifically described.

We claim:

1. A method comprising:

packaging and sterilizing a contact lens, wherein packaging comprises placing a contact lens in a recess of a package and sealing the recess with lidstock, and wherein sterilization comprises sterilizing the package contents, applying to the package a machine-readable code including information identifying specifications of the contact lens contained in the package;

and subsequently, applying to the package printed language information generated from the machine-readable code and identifying specifications of the contact lens contained in the package.

2. The method of claim 1, wherein the machine-readable code includes information identifying power of the contact lens contained in the package.

3. The method of claim 2, wherein the machine-readable code further includes information identifying at least one of base curve or diameter of the contact lens.

4. The method of claim 2, wherein the machine-readable code further includes information identifying at least one of manufacturing lot number, manufacturing date and contact lens expiration date.

5. The method of claim 1, comprising stepwise:

packaging the contact lens;

applying to the package the machine-readable code;

sterilizing the package contents; and applying to the package the printed language information generated from the machine-readable code.

6. A method comprising:

packaging and sterilizing a contact lens, wherein packaging comprises placing a contact lens in a recess of a package and sealing the recess with lidstock, and wherein sterilization comprises sterilizing the package contents, applying to the package a machine-readable code including information identifying specifications of the contact lens contained in the package;

and subsequently, at a site remote from packaging and sterilization operations, applying to the package printed language information generated from the machine-readable code and identifying specifications of the contact lens contained in the package.

7. The method of claim 6, comprising stepwise:

packaging the contact lens;

applying to the package the machine-readable code;

sterilizing the package contents; and applying to the package, at the site remote from packaging and sterilization operations, the printed language information generated from the machine-readable code.

* * * * *